US010036519B2

(12) United States Patent
Moon et al.

(10) Patent No.: US 10,036,519 B2
(45) Date of Patent: Jul. 31, 2018

(54) MODULAR LED RETROFIT LAMP SYSTEM

(71) Applicants: Brian Moon, Woodbridge, VA (US); John Luhrs, Marietta, GA (US)

(72) Inventors: Brian Moon, Woodbridge, VA (US); John Luhrs, Marietta, GA (US); Thomas Kennedy, Bristow, VA (US)

(73) Assignees: Brian Moon, Woodbridge, VA (US); John Luhrs, Marietta, GA (US)

( * ) Notice: Subject to any disclaimer, the term of this patent is extended or adjusted under 35 U.S.C. 154(b) by 226 days.

(21) Appl. No.: 15/140,364

(22) Filed: Apr. 27, 2016

(65) Prior Publication Data

US 2016/0319996 A1 Nov. 3, 2016

Related U.S. Application Data

(60) Provisional application No. 62/153,551, filed on Apr. 28, 2015.

(51) Int. Cl.

| | |
|---|---|
| ***F21V 17/00*** | (2006.01) |
| ***F21S 8/02*** | (2006.01) |
| ***F21K 9/233*** | (2016.01) |
| *F21V 23/00* | (2015.01) |
| *F21V 7/00* | (2006.01) |
| *F21V 29/67* | (2015.01) |
| *F21V 29/74* | (2015.01) |
| *F21Y 115/10* | (2016.01) |
| *F21K 9/68* | (2016.01) |

(52) U.S. Cl.

CPC ..... *F21S 8/02* (2013.01); *F21K 9/233* (2016.08); *F21K 9/68* (2016.08); *F21V 7/0066* (2013.01); *F21V 23/008* (2013.01); *F21V 29/67* (2015.01); *F21V 29/74* (2015.01); *F21Y 2115/10* (2016.08)

(58) Field of Classification Search

CPC ..... F21Y 2103/33; F21S 8/026; F21S 8/02; F21S 8/04; F21V 29/70; F21V 29/004; F21V 21/04; F21V 23/026

USPC ..... 362/364, 294, 373

See application file for complete search history.

(56) References Cited

U.S. PATENT DOCUMENTS 5,971,564 A 10/1999 Wang
7,125,159 B2 10/2006 Hirsch et al.

(Continued)

OTHER PUBLICATIONS

"Setting the standard in LED modules Philips Fortimo LED High Brightness Module", Philips website: http://www1.futureelectronics.com/doc/PHILIPS%20LIGHTING/929000636503.pdf.

*Primary Examiner* — William Carter

(74) *Attorney, Agent, or Firm* — Thomas|Horstemeyer, LLP

(57) ABSTRACT

The modular LED retrofit lamp system includes a high-power LED light engine, together with an integrated optics mount, an integrated yet serviceable LED dimmable driver, and a point of attachment on the center area of the engine for mounting the LED engine. Different mounts for the engine can include, but are not limited to, PAR56, PAR46, PAR64, PAR38, Mini Candelabra, Intermediate Screw Base, Mogul Screwbase, and Fresnel-based Theatrical Fixtures. One LED light engine can replace a wide range of tungsten lamps ranging up to 500 watt equivalents in output performance, as well as dimming performance. Additional brackets and lamp sockets easily retrofit into an existing lighting fixture, while dimming capabilities are retained.

9 Claims, 8 Drawing Sheets

(56) References Cited

U.S. PATENT DOCUMENTS

| | | | | |
|---|---|---|---|---|
| 7,862,214 | B2 * | 1/2011 | Trott | F21S 8/026 362/365 |
| 7,905,626 | B2 | 3/2011 | Shantha et al. | |
| 8,128,263 | B2 * | 3/2012 | Higuchi | F21S 8/02 362/345 |
| 8,262,258 | B2 | 9/2012 | VanderSluis et al. | |
| 8,485,713 | B2 | 7/2013 | Atalay | |
| 8,668,374 | B2 | 3/2014 | Yoo | |
| 8,696,158 | B2 | 4/2014 | Santiago et al. | |
| 8,721,134 | B1 | 5/2014 | Kliegl et al. | |
| 8,770,799 | B2 | 7/2014 | Becker et al. | |
| 8,770,806 | B2 | 7/2014 | Koo et al. | |
| 9,134,019 | B2 | 9/2015 | Thomas et al. | |
| 9,239,153 | B2 | 1/2016 | Goodman et al. | |
| 2005/0231964 | A1 | 10/2005 | Tufano, Sr. et al. | |
| 2009/0290343 | A1 * | 11/2009 | Brown | F21K 9/00 362/235 |

* cited by examiner

MODULAR LED RETROFIT LAMP SYSTEM

CROSS-REFERENCE TO RELATED APPLICATION

This application claims the benefit of U.S. Provisional Patent Application Ser. No. 62/153,551, filed Apr. 28, 2015.

BACKGROUND OF THE INVENTION

1. Field of the Invention

The present invention relates to lighting systems, and more particularly, to a modular LED retrofit lamp system.

2. Description of the Related Art

Light emitting diode (LED) lamps are only good for the intended socket they are designed for. Tungsten lamps have this same issue. A PAR56 lamp would only be able to function in a fixture that was designed to be used with that particular lamp. LED lamps are the same. A PAR38 LED Lamp is only designed to go into a PAR38 fixture, even though it could go into a standard lamp, as does an A19 lamp. High-power LED lamps are designed currently to go into a single lamp socket without having the means to fit into an existing lamp fixture. A complete redesign of the lamp itself would be required.

Thus, a modular LED retrofit lamp system solving the aforementioned problems is desired.

SUMMARY OF THE INVENTION

The modular LED retrofit lamp system includes a basic high-power LED light engine, together with an integrated optics mount, an integrated yet serviceable LED dimmable driver, and a point of attachment on the center area of the engine for mounting the LED engine. Different mounts for the engine can include, but are not limited to, PAR56, PAR46, PAR64, PAR38, Mini Candelabra, Intermediate Screw Base, Mogul Screwbase, and Fresnel-based Theatrical Fixtures. One LED engine can replace a wide range of tungsten lamps ranging up to 500 watt equivalents in output performance, as well as dimming performance. Additional brackets and lamp sockets easily retrofit into an existing lighting fixture, while dimming capabilities are retained.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
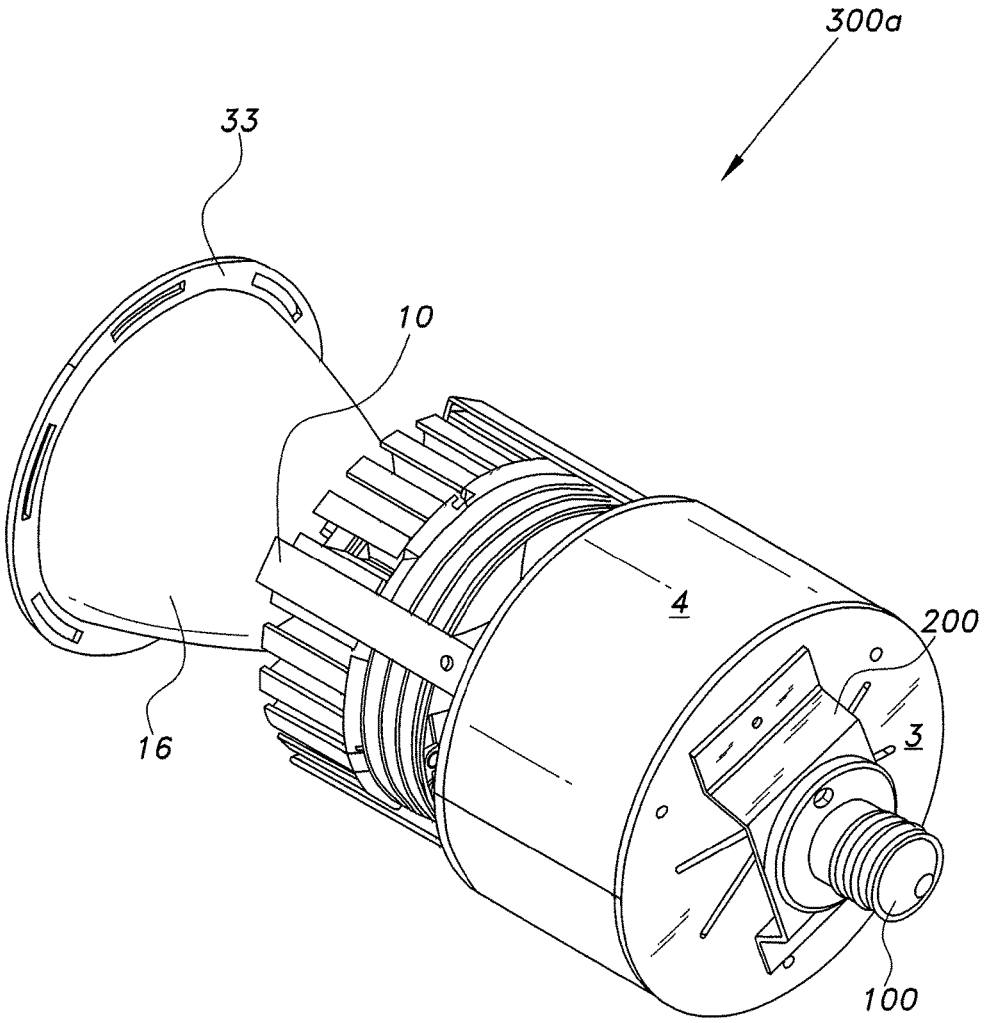
FIG. 1 is a perspective view of a modular LED retrofit lamp system with a screw-base according to the present invention, shown equipped with a screw-base.
Figure 2:
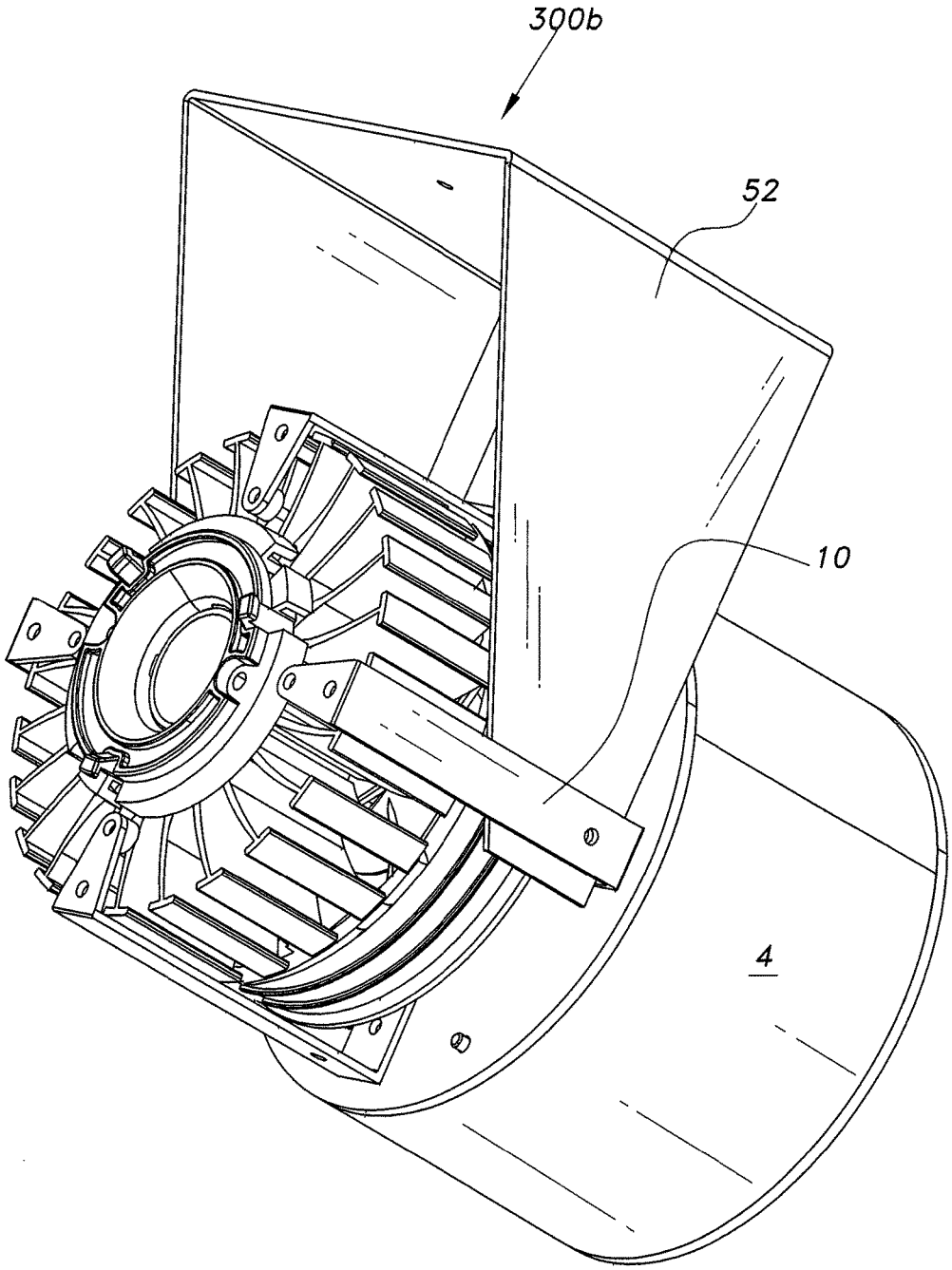
FIG. 2 is a perspective view of a modular LED retrofit lamp system according to the present invention, shown equipped with a Fresnel mount.
Figure 3:
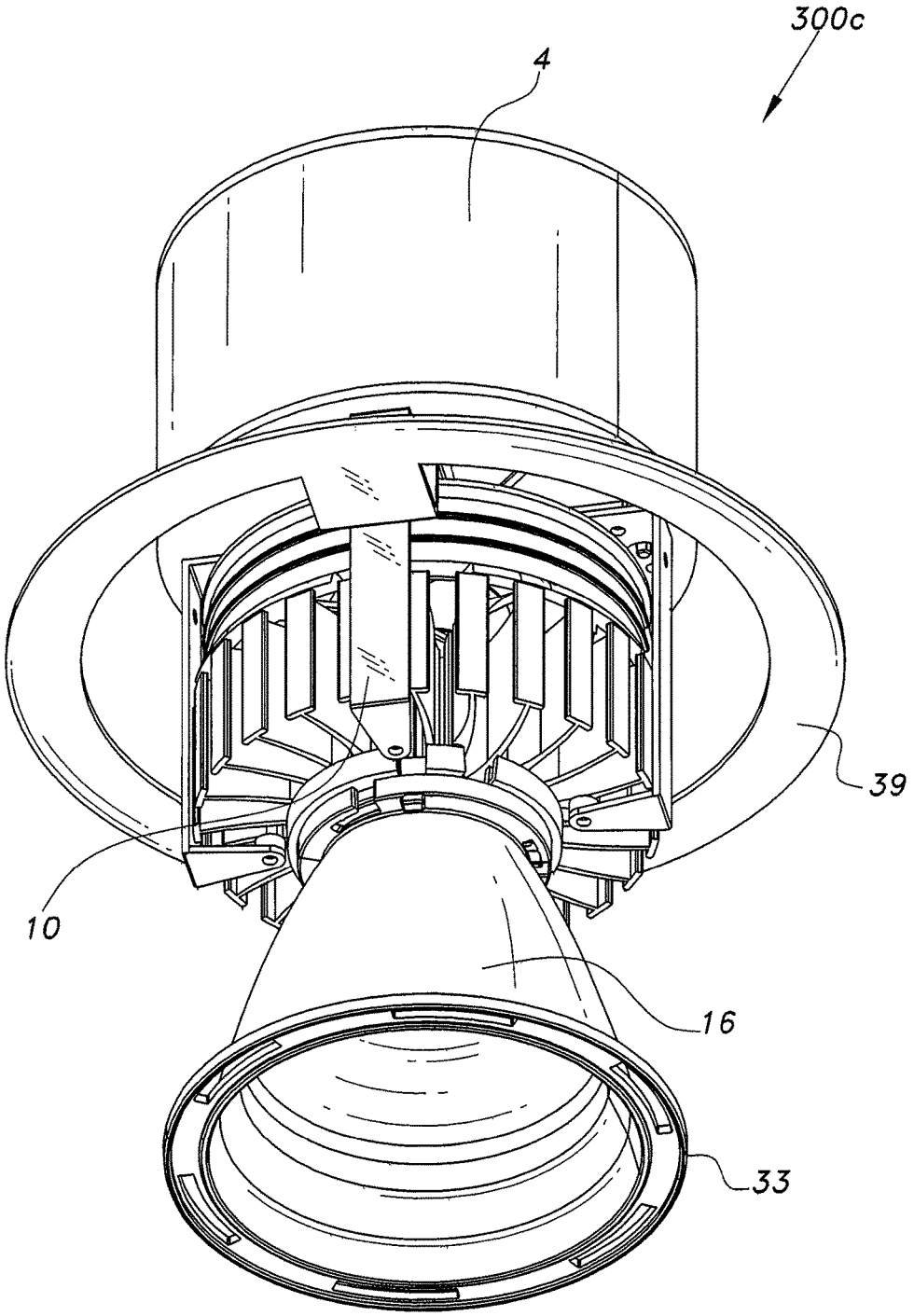
FIG. 3 is a perspective view of a modular LED retrofit lamp system according to the present invention, shown equipped with a PAR replacement ring.

Referring to FIGS. 1-3, the modular LED retrofit lamp system includes a basic high-power LED light engine, together with an integrated optics mount, an integrated yet serviceable LED dimmable driver, and a point of attachment on the center area of the engine for mounting the LED engine. Different mounts for the engine can include, but are not limited to, PAR56, PAR46, PAR64, PAR38, Mini Candelabra, Intermediate Screw Base, Mogul Screw base, and Fresnel-based Theatrical Fixtures. One LED light engine would be able to replace a wide range of tungsten lamps ranging up to 500 watt equivalents in output performance (or more generally, lamps in the range of 50 watts to 1,000 watts), as well as dimming performance. The LED light engine of the present modular LED retrofit lamp system is designed with the intent of adding additional brackets and lamp sockets in order to easily retrofit into an existing lighting fixture and still have the capabilities of dimming, like its tungsten predecessor, on a long range of commercial-grade dimmers.

Referring now to FIGS. 1-5, the base LED light engine 300*d* comprises custom and standard components. These components include, but are not limited to, the following: an LED driver that is modular and phase-dimmable; an actively cooled heat sink 12*a*, 12*b*, 12*c* in order to keep the driver cool and well-ventilated; and a high-power single point source emulated LED chip 14 mounted to the heat sink/fan combination 12*a*, 12*b*, 12*c*, being held together by a plastic mount, which also allows the optics to easily attach or detached. This "LED Engine", comprising the heat sink/fan 12*a*, 12*b*, 12*c*, LED, LED Holder and optics, is attached to the driver enclosure 4 via two custom brackets 10, 11 with side-mount holes. The holes in these brackets allow for different types of mounting brackets and adapters to attach to in order to hold the light engine in its place inside the existing lighting fixture it is being adapted too. In terms of a PAR56 or PAR64 Fixture, a trim ring 39 (shown in FIG. 3) having flange openings designed to bolt into the side of custom arm brackets allows the engine to fit perfectly into the existing fixture. In terms of a Fresnel lamp replacement, the setup may be similar to the PAR56 and 64 by having the bracket furnished to provide a Fresnel mount 52 for the base LED light engine with driver. For a screw-in base lamp, there are holes on top of the driver case to allow for a medium base mate screw base 100 to be installed. Numerous standard lamp base adapters can be attached to the medium screw base male connector (E26/E27).

Figure 4:
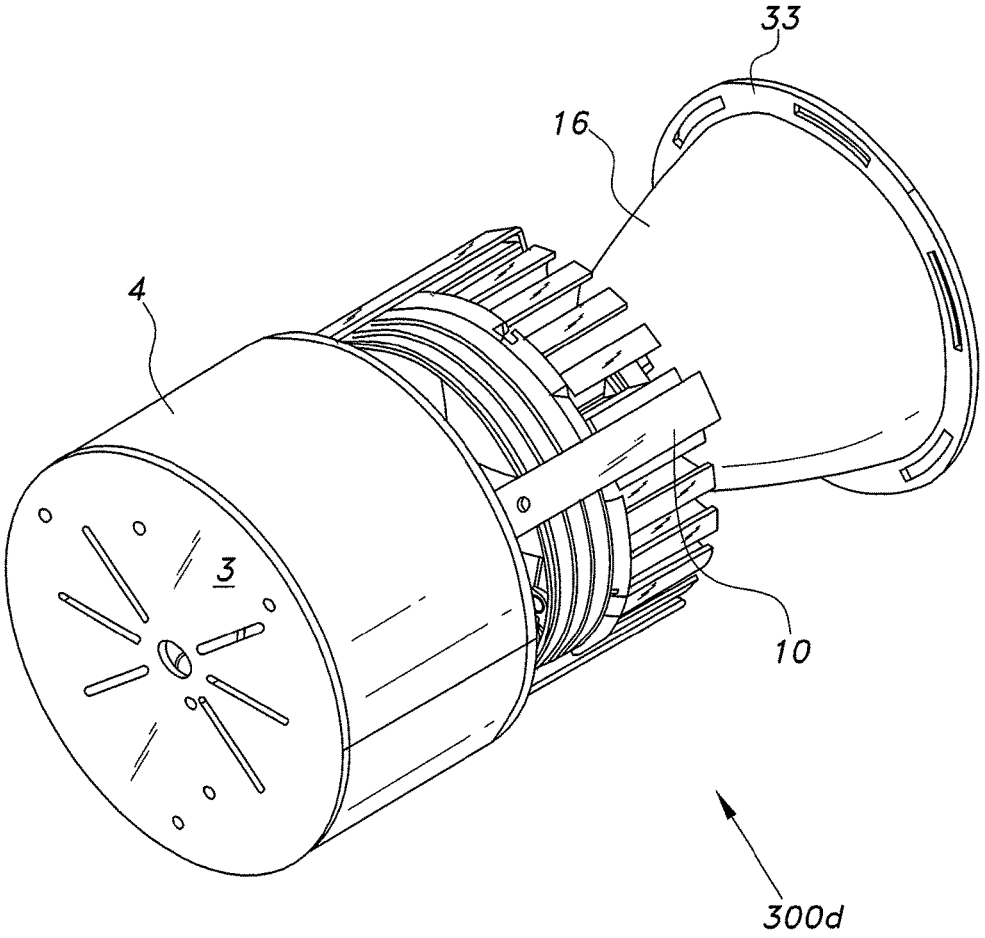
FIG. 4 is a perspective view of a modular LED retrofit lamp system according to the present invention, shown equipped with a base engine mount.
Figure 5:
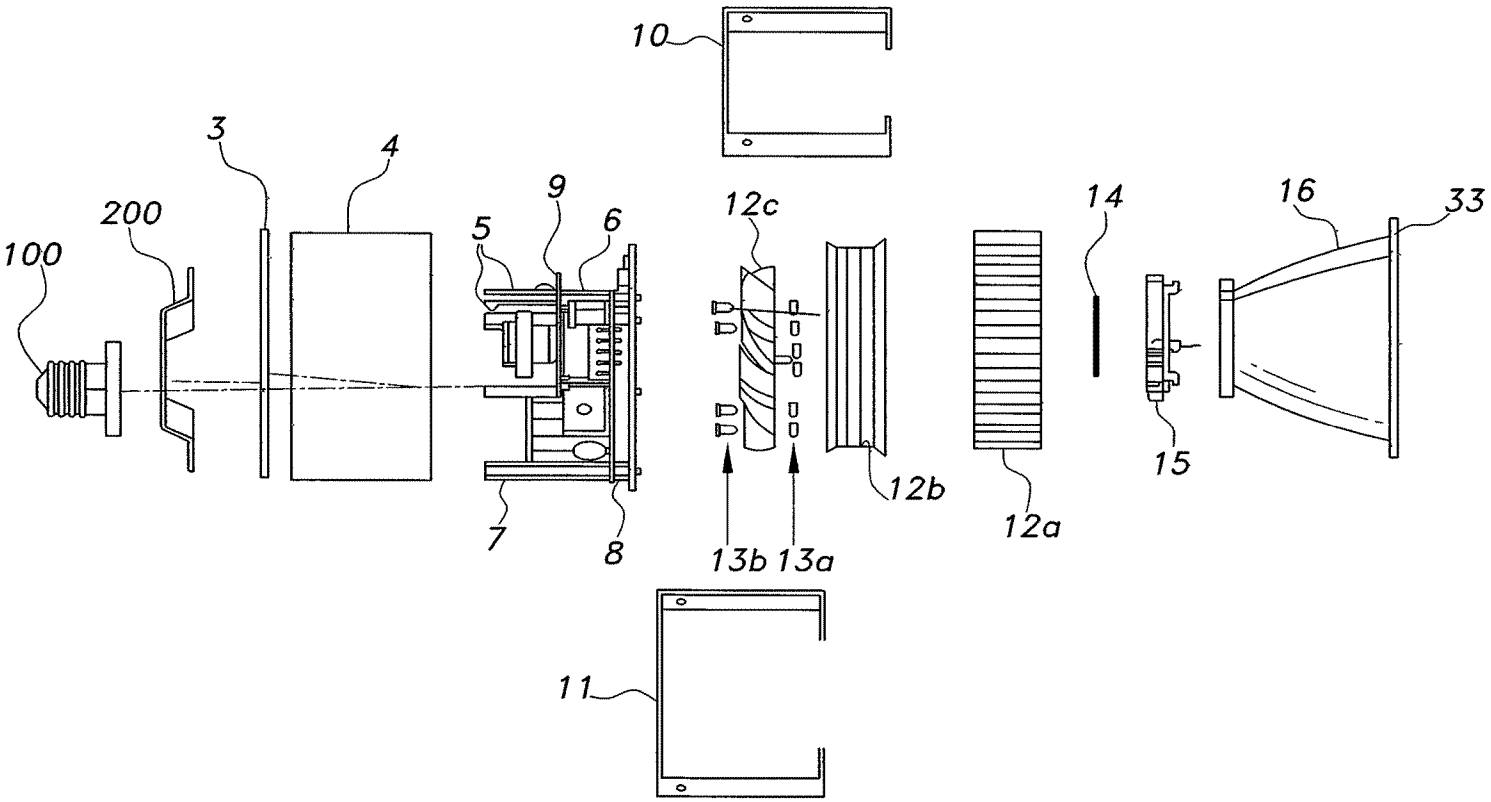
FIG. 5 is an exploded view of an exemplary modular LED retrofit lamp system according to the present invention.
Figure 6:
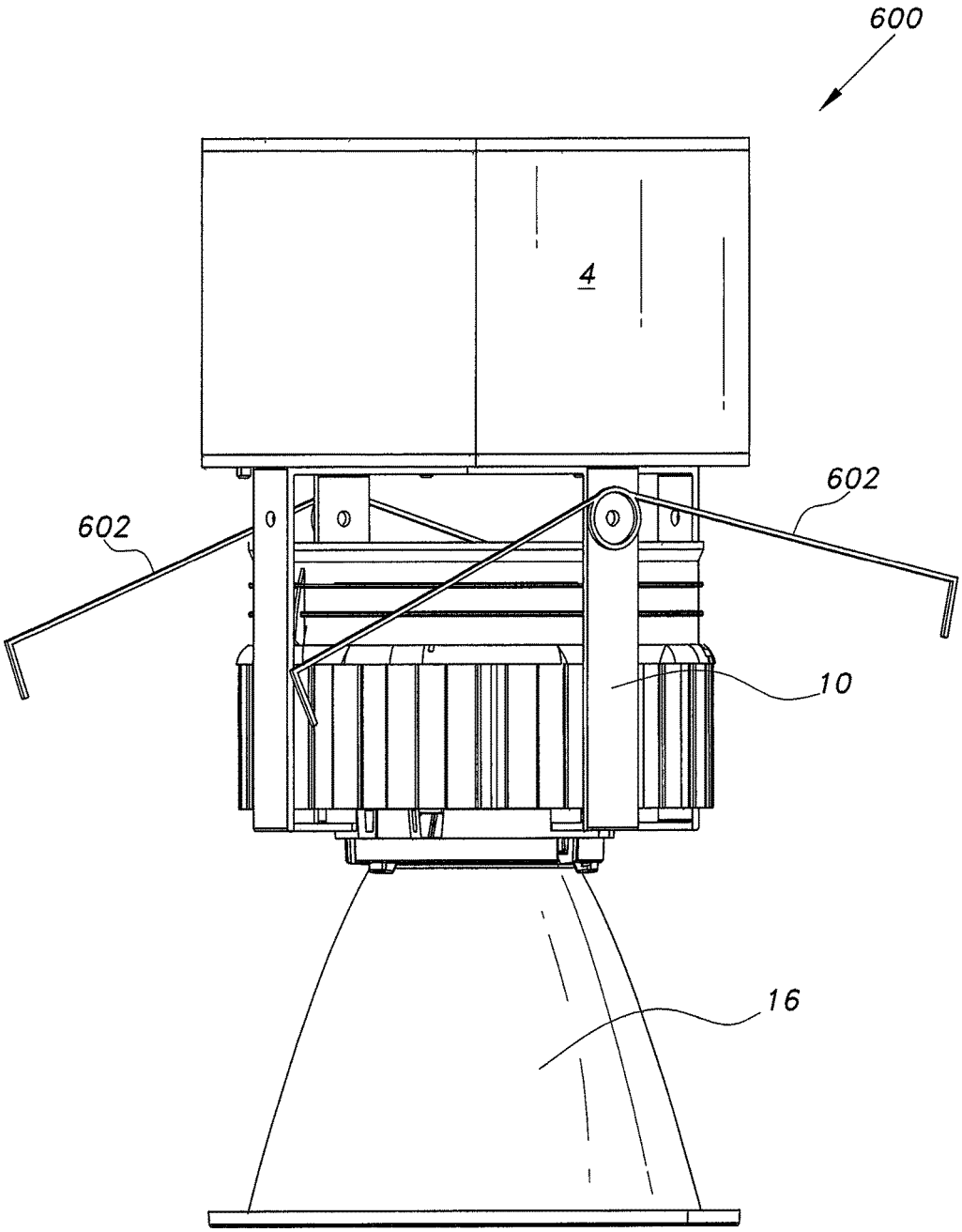
FIG. 6 is a perspective view of a modular LED retrofit lamp system according to the present invention, shown equipped with a spring mount.

In a preferred embodiment, shown in FIG. 5, a modular annular heat sink assembly comprises heat sink fins 12*a*, which are disposed over a plastic nylon spacer 12*b*. The assembly is retained by a driver thermal protection ring 12*c* attached via fasteners 13*b*, which are secured by nuts 13*a*. The modular annular heat sink assembly 12*a*, 12*b*, 12*c* is in coaxial arrangement with an annular shaped optics holder 15 that functions as a holder for LED optics 14, the optics holder 15 attaching to a substantially conic section-shaped LED engine reflector 16. The LED engine reflector 16 has a reflector attachment flange 33 disposed around a largest circumference of the LED engine reflector 16. The conical reflector 16 is exemplary, and it will be understood that the optics may use PMMA (poly (methyl methacrylate))-based, silicone-based, or TIR (total internal reflection)-based optics, or aluminum, glass, or anti-reflective glass-based optics. A high-power single point source emulated LED chip 14 is disposed between the heat sink assembly 12*a,* 12*b,* and 12*c* and the optics holder 15, the high-power single point source emulated LED chip 14 being recessed into a center opening of the heat sink fin portion 12*a*. Posterior to the heat sink and reflector assembly are two C-shaped custom mounting brackets 10 and 11. The C-shaped custom mounting brackets 10 and 11 have overhanging open portions of the C shape that attach to anterior-most portion 12*a* of the heat sink assembly and posterior-most portion 12*c* of the heat sink assembly. Bottom closed portions of mounting brackets 10 and 11 are adaptable to fit a variety of lamp fixture housings, as the holes in these brackets allow for different types of mounting brackets and adapters to attach to in order to hold the light engine in its place inside the existing lighting fixture it is being adapted to. In the exemplary modular LED retrofit lamp system shown in FIG. 5, bottom closed portions of mounting brackets 10 and 11 are attached to a custom dimensioned tubular can 4 which houses an LED driver attached to a custom plate 8, which, in turn, is adapted for the attachment of the brackets 10 and 11 thereto. The LED driver comprises modular circuit boards 5, 6, 7, and 9, and may include LED dimmer circuitry, and the like. The LED driver is in operable communication with the LED light engine 14. A posterior plate 3 attaches to posterior portion of the tubular can 4 to completely enclose the LED driver assembly. An Edison mount flange 200 attaches to an exposed portion of the custom plate 3, the Edison mount flange 200 retaining an Edison mount threaded electrical contact adapter 100. The Edison mount threaded adapter 100 is in operable communication with the LED driver circuitry 5, 6, 7, and 9. A perspective view of the Edison mount embodiment 300*a* is shown in FIG. 1. As shown in FIG. 2, in the Fresnel mount embodiment 300*b,* a Fresnel mount is attached to the brackets 10 and 11 in lieu of the Edison mount assembly. As shown in FIG. 3, an oversized annular mounting ring 39 is attached to the brackets 10 and 11 to provide a recess lighting configuration 300*c* in lieu of the Edison mount assembly. The oversized annular mounting ring 39 is approximately one inch larger in diameter than the can 4. As shown in FIG. 4, the base engine 300*d* includes the can 4 without any particular mounting option installed. A spring mount embodiment 600, shown in FIG. 6, includes dual elongate armed spring mounts 602 affixed to attachment points on opposing sides of one of the C-shaped mounting brackets 10, 11 proximate the tubular can 4 of the modular LED lamp fixture.

Figure 7:
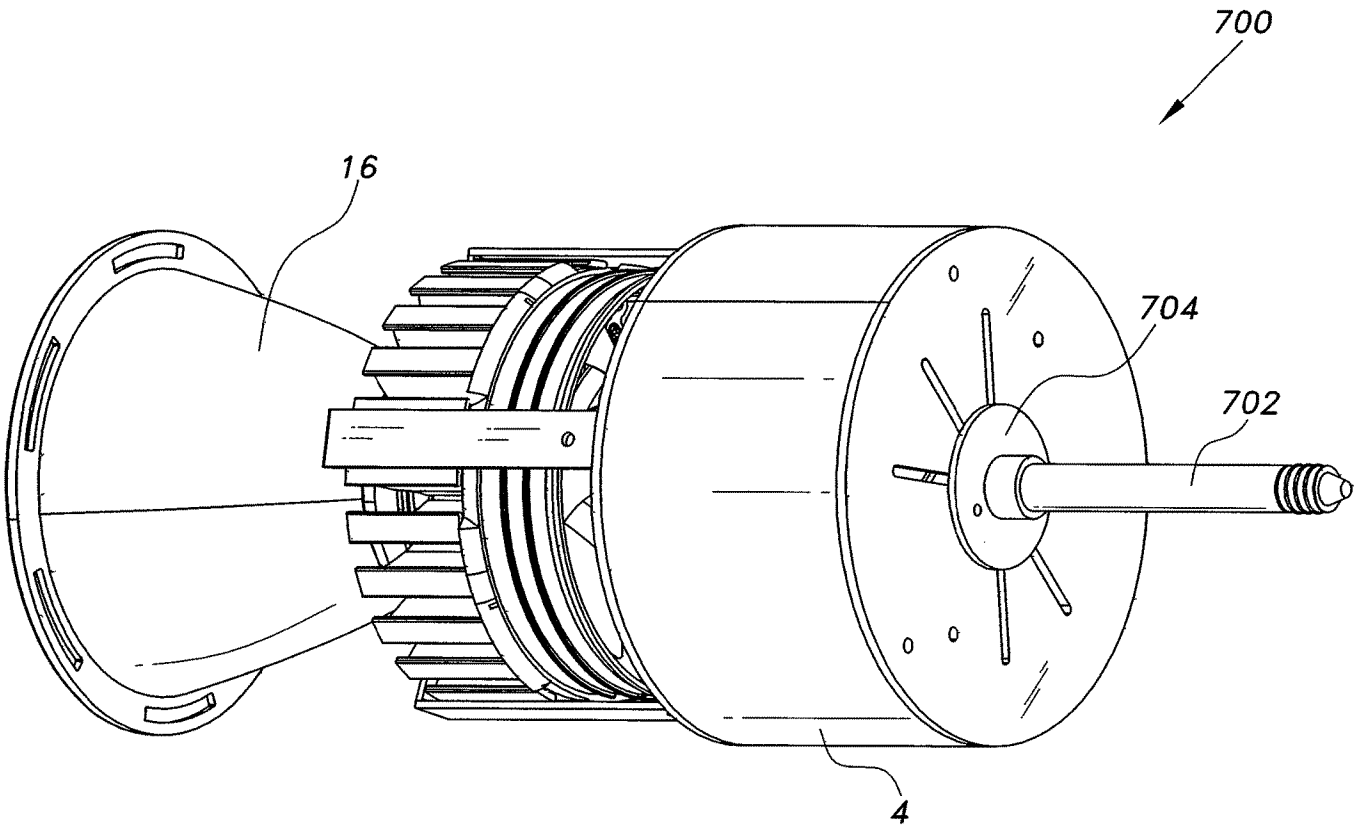
FIG. 7 is a perspective view of a modular LED retrofit lamp system according to the present invention, shown equipped with an E11 mini-candelabra mount.

A mini-candelabra mount embodiment 700, shown in FIG. 7, includes an elongate, cylindrical mini candelabra screw mount electrical contact 702 that extends into a circular planar member 704, which attaches to a posterior portion of the tubular can 4, the mini candelabra screw mount electrical contact 702 being in operable communication with the LED driver.

Figure 8:
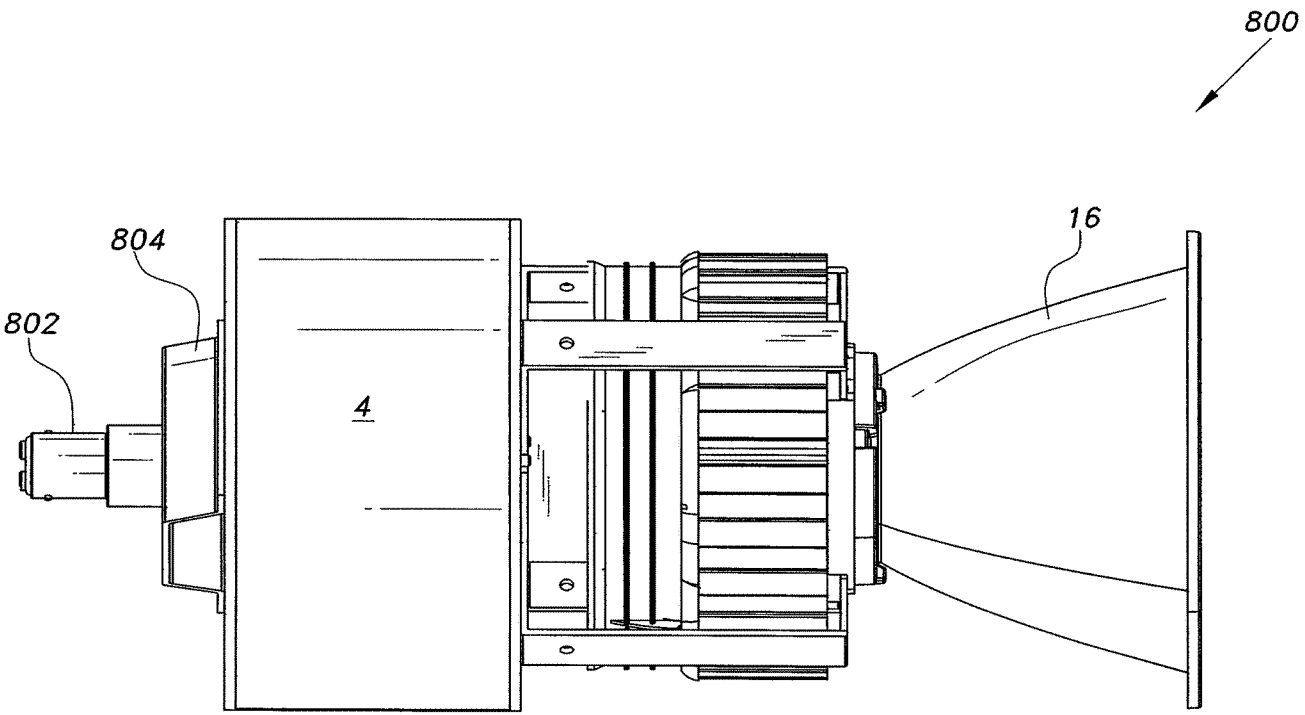
FIG. 8 is a perspective view of a modular LED retrofit lamp system according to the present invention, shown equipped with a BA15D mount.

A BA15D mount embodiment 800, shown in FIG. 8, includes a BA15D plug-in mount electrical contact 802 that attaches to a BA15D mounting flange 804, the BA15D mounting flange, in turn, being attached to a posterior portion of the can 4 to form the BA15D mount embodiment 800, the BA15D plug-in mount electrical contact 802 being in operable communication with the LED driver.

A method of making the present modular LED lamp fixture may include the mounting of the LED chip 14 to the heat sink assembly 12*a*-12*c* with thermal compound disposed between the LED and aluminum heat sink/fan assembly 12*a,* 12*c* attached via plastic nylon spacer 12*b*. Via use of the optics holder 15 that holds the optics, screws 13*b* are placed into the heat sink and secured by nuts 13*a,* this configuration holding the LED 14 firmly onto the heat sink 12*a,* 12*c,* as well as holding the removable optics. Next, the aluminum arm brackets 10, 11 are mounted to the heat sink/fan 12*a,* 12*c*. The brackets 10, 11 allow for the driver enclosure 4 to be mounted to the heat sink 12*a,* 12*c*. Once the brackets 10, 11 are installed, the plastic nylon spacer 12*b* is disposed between the driver thermal protection 12*c* and the LED thermal protection 12*a,* the plastic nylon spacer 12*b* acting as a thermal separator. PCB stand-offs are mounted on the anterior plate 8 of the driver enclosure. Once the PCB stand-offs are attached, the anterior plate 8 is mounted to the arm brackets 10, 11 using screws and nuts. When the anterior plate 8 is mounted, the LED driver is attached using a series of stand-offs to stack the fan electronics 9 from the LED electronics 6. Once the driver is mounted, the tube piece (can 4) is slid over the assembly to cover and protect the electronics, the posterior plate 3 being mounted using fasteners disposed in the existing top holes of the driver PCB, thereby acting as a sandwiching assembly that holds components of the present modular LED retrofit lamp system in place. Once the base engine 300*d* is assembled, the custom metal brackets and wiring are attached to the fixture, thereby enabling the fixture to receive power. The LED and fan on the heat sink are wired back to the LED driver electronics, where it will be able to control the LED 14, as well as the fan, while it is being dimmed by a standard forward phase/reverse phase dimmer.

A method of using the present modular LED retrofit lamp system may include, for example, using the base engine to determine the best way of attaching the LED light engine into an existing fixture. In terms of a screw-in base, i.e., E11, E17, E12, E26, E27, E29, or the like, mount the Edison Male E26 base adapter to the top of the base engine. Depending on the depth of the socket to the reflector of the existing fixture, the depth of the bracket may be adjusted in order to have the lamp system remain inside of the fixture. Then, use an existing adapter to screw onto the lamp base and screw into the existing lamp socket. If doing any other adaptations, start with the base engine and attach means of mechanical attachment to the side of the mount arms, while using bare wires coming from the rear of the fixture to either attach a lamp socket adapter or to hard-wire the unit directly into the existing fixture.

It is to be understood that the present invention is not limited to the embodiments described above, but encompasses any and all embodiments within the scope of the following claims.

We claim:

1. A modular LED retrofit lamp system, comprising:

an LED light engine having a high-power single point source emulated LED chip;

an LED driver in operable communication with the LED chip;

an annular LED chip thermal protection heat sink;

an annular LED driver thermal protection heat sink;

an LED light engine reflector;

an LED optics holder disposed in coaxial alignment with and attached to the LED light engine reflector;

a plastic nylon spacer disposed in coaxial alignment with and attached to the LED driver thermal protection heat sink, the spacer also being disposed in coaxial alignment with and attached to the LED thermal protection heat sink;

an anterior heat sink recess formed by the heat sink attachment of the spacer and the heat sinks, the LED chip being disposed inside the anterior heat sink recess, the LED optics holder being attached to the LED heat sink within the anterior heat sink recess to secure the LED chip inside the anterior heat sink recess;

an anterior plate attached to the LED driver, the plate also being attached to a posterior portion of the LED driver thermal protection heat sink;

two C-shaped mounting brackets each of the brackets having an open portion disposed adjacent to an anterior portion of the thermal protection heat sinks and closed portions disposed adjacent to a posterior portion of the thermal protection heat sinks;

a tubular housing having an anterior opening and a posterior opening, the LED driver being disposed within the tubular housing, the anterior plate being substantially flush-mounted to the anterior opening of the tubular housing; and a posterior plate flush-mounted to the tubular housing and covering the posterior opening of the tubular housing.

2. The modular LED retrofit lamp system according to claim 1, further comprising:

an Edison mount flange attached to an exposed portion of the posterior plate; and an Edison threaded electrical contact attached to and secured by the Edison mount flange, the Edison threaded electrical contact being in operable communication with the LED driver.

3. The modular LED retrofit lamp system according to claim 1, further comprising a Fresnel mount attached to and secured by the C-shaped mounting brackets, the Fresnel mount being disposed between the tubular housing and the heat sinks.

4. The modular LED retrofit lamp system according to claim 1, further comprising dual elongate armed spring mounts affixed to opposing sides of one of the C-shaped mounting brackets proximate the tubular housing.

5. The modular LED retrofit lamp system according to claim 1, further comprising:

a circular planar member attached to an exposed portion of the posterior plate of the tubular housing; and an elongate, cylindrical mini candelabra screw mount electrical contact attached to the circular planar member, the mini candelabra screw mount electrical contact being in operable communication with the LED driver.

6. The modular LED retrofit lamp system according to claim 1, further comprising:

a BA15D mounting flange attached to an exposed portion of the posterior plate of the tubular housing; and a BA15D plug-in mount electrical contact attached to and secured by the BA15D mounting flange, the BA15D plug-in electrical contact being in operable communication with the LED driver.

7. The modular LED retrofit lamp system according to claim 1, further comprising a trim ring selectively attached to the brackets, allowing the modular LED retrofit lamp system to fit perfectly into an existing fixture, the trim ring being attached between the heat sinks and the tubular housing and in coaxial alignment with the heat sinks and the tubular housing by the C-shaped mounting brackets.

8. The modular LED retrofit lamp system according to claim 7, wherein the trim ring has a diameter about one inch greater than the tubular housing.

9. The modular LED retrofit lamp system according to claim 7, wherein the LED engine reflector has a small circumference end and a large circumference end, the reflector including an attachment flange disposed around the large circumference end.

* * * * *